US007107710B2

(12) United States Patent
Savard

(10) Patent No.: US 7,107,710 B2
(45) Date of Patent: Sep. 19, 2006

(54) MOUNTING BRACKET FOR SIDE BLADE

(76) Inventor: Normand Savard, 1097 Normandie, Baie-Comeau (CA) G5C 3P9

( * ) Notice: Subject to any disclaimer, the term of this patent is extended or adjusted under 35 U.S.C. 154(b) by 236 days.

(21) Appl. No.: 10/851,130

(22) Filed: May 24, 2004

(65) Prior Publication Data

US 2005/0257406 A1 Nov. 24, 2005

(51) Int. Cl.
*E01H 5/06* (2006.01)

(52) U.S. Cl. ..... 37/274; 37/281

(58) Field of Classification Search ..... None
See application file for complete search history.

(56) References Cited

U.S. PATENT DOCUMENTS 2,569,053 A * 9/1951 Healy ..... 414/633
2,991,566 A 7/1961 Sumner et al.
3,659,363 A * 5/1972 Snyder ..... 37/231
4,045,892 A 9/1977 Farrell
4,096,652 A 6/1978 Raines et al.
4,357,766 A 11/1982 Croteau et al.
4,744,159 A * 5/1988 Houle ..... 37/231
4,969,280 A 11/1990 Thorneloe
5,031,343 A * 7/1991 Houle et al. ..... 37/231
6,363,631 B1 * 4/2002 Cordingley ..... 37/280
7,000,338 B1 * 2/2006 Savard ..... 37/274

* cited by examiner

*Primary Examiner*—Meredith C. Petravick
(74) *Attorney, Agent, or Firm*—Equinox Intl; Franz Bonsang PA

(57) ABSTRACT

A frontward blade mounting bracket, for connecting the front end of a side blade to a vehicle side adjacent a road surface, includes a spacer and an elongate guide member. The spacer has opposed first and second spacer ends. The first spacer end is pivotally connected to the vehicle side about a substantially vertical pivot axis, and the second spacer end is spaced apart from the first spacer end in a direction leading outwardly away from the vehicle side. The guide member has first and second guide parts connected to the second spacer end and the second guide part respectively. The first and second guide parts longitudinally move relative to one another about a substantially vertical guide axis.

20 Claims, 4 Drawing Sheets

MOUNTING BRACKET FOR SIDE BLADE

FIELD OF THE INVENTION

The present invention relates to side blade holding systems and methods and is more particularly concerned with a frontal bracket for side blade for snowplow.

BACKGROUND OF THE INVENTION

It is well known in the art to use a frontal bracket for mounting a side wing or blade on a vehicle to remove snow or other materials from a pavement or roadside. In particular, wings are usually non-permanently mounted, such as for the winter season, on a motor vehicle, and more specifically on a 2 to 3 tons truck with a low profiled chassis. In the prior art, U.S. Pat. No. 2,991,566 issued to Sumner et al. on Jul. 11, 1961; U.S. Pat. No. 3,659,363 issued to Snyder on May 2, 1972; U.S. Pat. No. 4,045,892 issued to Farrell on Sep. 6, 1977; U.S. Pat. No. 4,096,652 issued to Raines et al. on Jun. 27, 1978; U.S. Pat. No. 4,357,766 issued to Croteau et al. on Nov. 9, 1982 and U.S. Pat. No. 6,363,631 issued to Cordingley on Apr. 2, 2002 show a frontal bracket holding the forward section of a side wing via a vertical axis wing attachment pivot that is often combined with a frontward lifting means. In those cases however, the pivot is adjacent the wing whilst the frontward lifting means is secured on the vehicle via a generally complex mounting arrangement.

Other differences and difficulties with the existing type of frontal mounting bracket are the restrictions given under various circumstances. A first situation is that the actual positioning of the frontward lifting means, which includes a substantially vertical post, often partially obstructs the view of the driver of the vehicle. In another situation which usually cannot be controlled by the driver, the frontward lifting means prevents the full opening of the hood of the vehicle, that is generally overcome with prior disassembly of some parts of the mounting arrangement. In a third situation, when the vehicle is to be used without the side wing, such as during the summer period, the visually obstructing and cumbersome frontward lifting means generally remains mounted on the vehicle.

Accordingly, there is a need for an improved frontward mounting bracket for side blade with a simple configuration.

SUMMARY OF THE INVENTION

It is therefore a general object of the present invention to provide an improved mounting bracket for side blade.

An advantage of the present invention is that the mounting bracket for side blade provides for a pivoting means adjacent a motor vehicle with a frontward lifting means adjacent the side blade.

Another advantage of the present invention is that the mounting bracket for side blade does not restrict vision to the driver of the vehicle.

A further advantage of the present invention is that the mounting bracket for side blade does not prevent direct opening of the hood of the vehicle.

Still another advantage of the present invention is that the mounting bracket for side blade can be removed easily whilst including concurrently the removal of the substantially vertical frontward lifting means, to substantially clear off any blade attachment components from the vehicle.

According to an aspect of the present invention, there is provided a bracket for connecting a side blade to a vehicle side adjacent a road surface, the side blade having opposed first and second blade longitudinal ends defining a longitudinal blade axis therebetween, the bracket comprises: a spacer having opposed first and second spacer ends, the first spacer end being positionable adjacent the vehicle side and pivotally connectable thereto about a substantially vertical pivot axis, the second spacer end being spaced apart from the first spacer end in a direction leading outwardly away from the vehicle side; and an elongate guide member defining a substantially vertical guide axis, the guide member having first and second guide parts longitudinally moving relative to one another, the first guide part connecting to the second spacer end, the second guide part being pivotally connectable to the first blade end about a substantially horizontal axis.

In one embodiment, the second guide part includes a channel longitudinally extending therealong, the first guide part being in guiding engagement with the channel for longitudinal displacement relative to the second guide part.

Typically, the first guide part is an elongate plate, the channel having a C-shaped cross-sectional configuration for being longitudinally engageable by the elongate plate.

In another aspect of the present invention, there is provided aside blade mountable on a motor vehicle for plowing material located onto an adjacent ground surface away from a vehicle side thereof, the side blade comprises: generally opposed first and second blade longitudinal ends defining a longitudinal blade axis therebetween, the second blade end being movably connected to the vehicle side rearwardly away from a front end thereof; a bracket for connecting the first blade end adjacent the vehicle front end, the bracket including: a spacer having opposed first and second spacer ends, the first spacer end pivotally connecting to the vehicle side adjacent the front end about a substantially vertical pivot axis, the second spacer end being spaced apart from the first spacer end in a direction leading outwardly away from the vehicle side; an elongate guide member defining a substantially vertical guide axis, the guide member having first and second guide parts longitudinally, moving relative to one another, the first guide part connecting to the second spacer end, the second guide part connecting to the side blade adjacent the first blade end.

In a further aspect of the present invention, there is provided a motor vehicle for plowing material located onto an adjacent ground surface away from a vehicle side thereof, the vehicle comprises: a side blade having generally opposed first and second blade longitudinal ends defining a longitudinal blade axis therebetween, the second blade end being movably connected to the vehicle side rearwardly away from a front end thereof; a bracket for connecting the first blade end adjacent the vehicle front end, the bracket including: a spacer having opposed first and second spacer ends, the first spacer end pivotally connecting to the vehicle side adjacent the front end about a substantially vertical pivot axis, the second spacer end being spaced apart from the first spacer end in a direction leading outwardly away from the vehicle side; an elongate guide member defining a substantially vertical guide axis, the guide member having first and second guide parts longitudinally moving relative to one another, the first guide part connecting to the second spacer end, the second guide part connecting to the side blade adjacent the first blade end.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION OF THE PREFERRED EMBODIMENTS

With reference to the annexed drawings the preferred embodiments of the present invention will be herein described for indicative purpose and by no means as of limitation.

Figure 1:
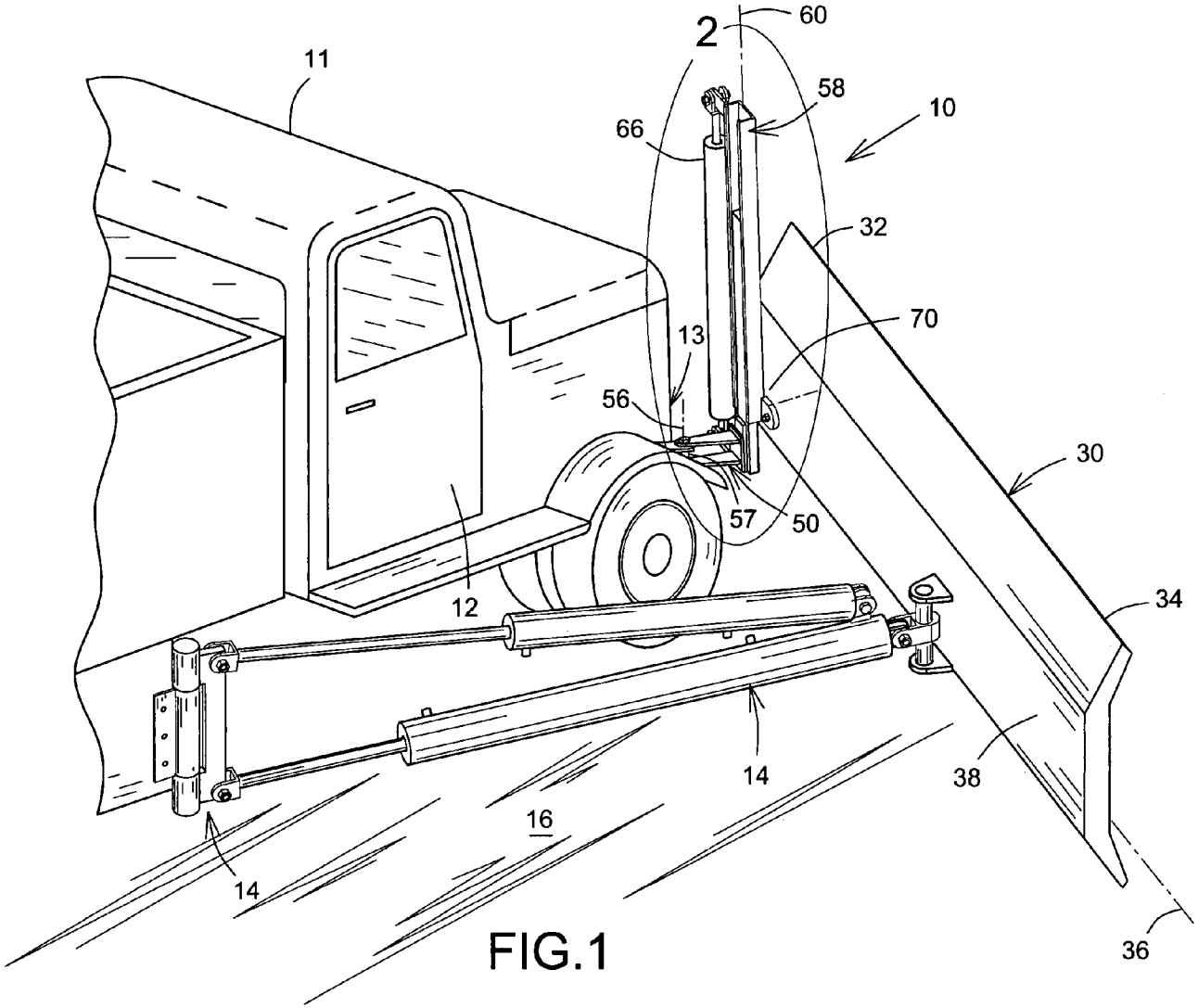
FIG. 1 is a top perspective view of an embodiment of a frontward mounting bracket for side blade in accordance with the present invention, showing the side blade in an operative extended configuration on the side of a motor vehicle.

Referring to FIG. 1, there is schematically shown an embodiment of a frontward mounting bracket 10 in accordance with the present invention to connect a side blade 30, or side wing, to a side 12 of a motor vehicle 11 such as a truck or the like, preferably adjacent a front end 13 of the vehicle side 12. Whilst FIG. 1 shows the side blade 30 in an operative extended configuration for removing snow or the like (not shown) accumulated on the road or ground surface 16 on the side of the vehicle 11 adjacent thereto, FIG. 1*a* shows the side blade 30 in the stowed retracted configuration with the side blade 30 against the vehicle side 12 and lifted above the road surface 16.

The side blade 30 is connected to the vehicle side 12 adjacent the road surface 16. The side blade 30 has opposed first and second blade longitudinal ends 32, 34 that define a longitudinal blade axis 36 there between and a blade plane 38. The first blade end 32 typically connects to the vehicle side 12 via the bracket 10 while the second blade end 34 generally connects to the vehicle side 12 rearwardly away from the front end 13 thereof via any type of rear attachment mechanism 14 for selective retraction and extension of the side blade 30 relative to the vehicle side 12.

Figure 1A:
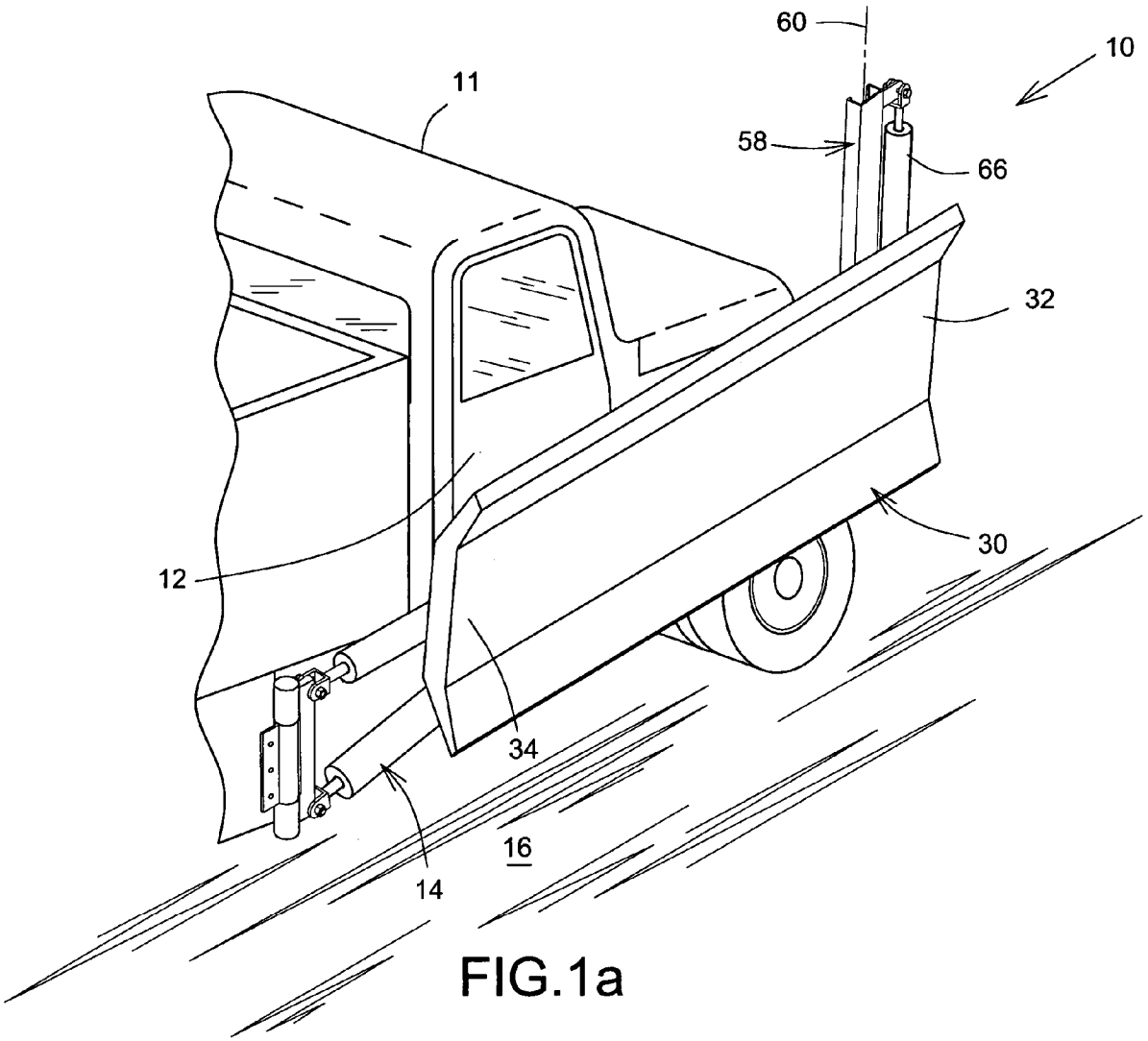
FIG. 1*a* is a perspective view of the embodiment of FIG. 1, showing the side blade in a stowed retracted configuration.
Figure 2:
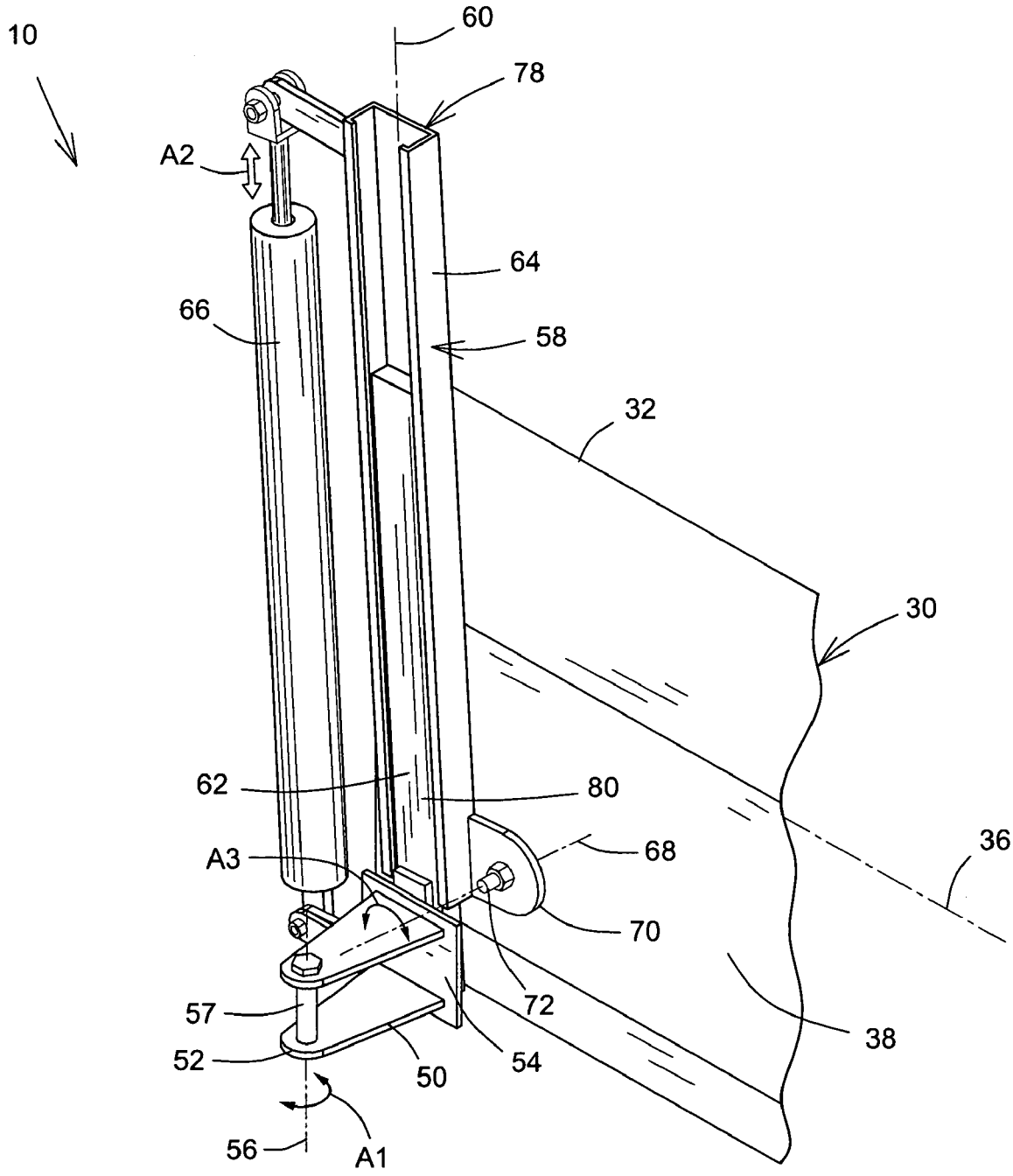
FIG. 2 is an enlarged perspective view taken along line 2 of FIG. 1.

As shown in more details in FIG. 2, the bracket 10 includes a spacer 50 and an elongate guide member 58. The spacer 50 has opposed first and second spacer ends 52, 54. The first spacer end 52 is pivotally connected about a substantially vertical pivot axis 56 to the vehicle side 12 generally adjacent the front end 13 via hinge rod 57 to allow for lateral extension and retraction of the side blade 30, as shown in FIGS. 1 and 1*a*, respectively. The pivotal movement about the pivot axis 56 is indicated by arrow A1. The second spacer end 54 is spaced apart from the first spacer end 52 in a direction leading generally outwardly away from the vehicle side 12 such that the guide member 58 is located substantially away from the vehicle side 12 relative to the pivot axis 56 to allow a better (less obstructed) field of view to the vehicle driver.

The guide member 58 defines a substantially vertical guide axis 60, although it could be typically slightly tilted from the vertical, substantially tangentially oriented relative to a predetermined position of the interface between the side blade 30 and the rear attachment mechanism 14, for proper mechanical interaction with the rear attachment mechanism 14 during raising displacement of the first blade end 32 relative to the vehicle side 12, with the second blade end 34 generally raised in the stowed configuration, as shown in FIG. 1*a*.

Accordingly, the guide axis 60 is substantially perpendicular to the blade axis 36. The guide member 58 includes first and second guide parts 62, 64 that move relative to one another. The first guide part 62 is connected to the second spacer end 54 and the second guide part 64 is connected to the side blade 30 adjacent the first blade end 32. The bracket 10 also includes an actuator 66 connecting the first and second guide parts 62, 64. The actuator 66, which is a hydraulic ram or the like, longitudinally moves the first and second guide parts 62 and 64 relative to one another along the guide axis 60 as indicated by arrow A2. The second guide part 64 is typically pivotally connected to the first blade end 32, via an extension plate 70 about a substantially horizontal axis 68, for a pivotal movement around a blade pivot 72 as indicated by arrow A3. The horizontal axis 68 is furthermore substantially transversal to the blade plane 38 to allow the second blade end 34 to move up and down during retraction and extension thereof respectively.

In a preferred embodiment 10 as shown in FIG. 2, the second guide part 64 is a beam, or the like, that includes a channel 78 longitudinally extending there along. Typically, the channel 78 has a C-shaped cross-sectional configuration. The first guide part 62 is preferably an elongate plate 80 that slidably engages the channel 78 for guided longitudinal displacement relative to the second guide part 64.

The present invention further refer, by no means as of limitation, to a side blade 30 having a bracket 10 as described hereinabove and a motor vehicle 11 including such a bracket 10.

Operation

Starting from the stowed retracted configuration of the side blade 30 of FIG. 1*a*, the actuator 66 is activated to, at least partially, lower the beam 64 and the first blade end 32 toward the road surface 16 along the guide axis 60 relative to the plate 80, that is vertically fixed relative to the vehicle side 12, engaged in the channel 78, and as indicated by arrow A2 on FIG. 2. Typically simultaneously, the rear attachment mechanism 14 pushes the second blade end 34 down and away from the vehicle side 12, forcing pivoting actions of the side blade 30 about the horizontal axis 68 and of the spacer 50 of the bracket 10 about the pivot axis 56, as shown by arrows A3 and A1 on FIG. 2 respectively. Once the side blade 30 substantially reaches its operative extended configuration of FIG. 1, the actuator 66 is then further activated, if needed, to completely lower the first blade end 32 in contact engagement with the road surface 16.

To return to the retracted configuration, the reverse operations are performed.

Alternatives

Figure 2A:
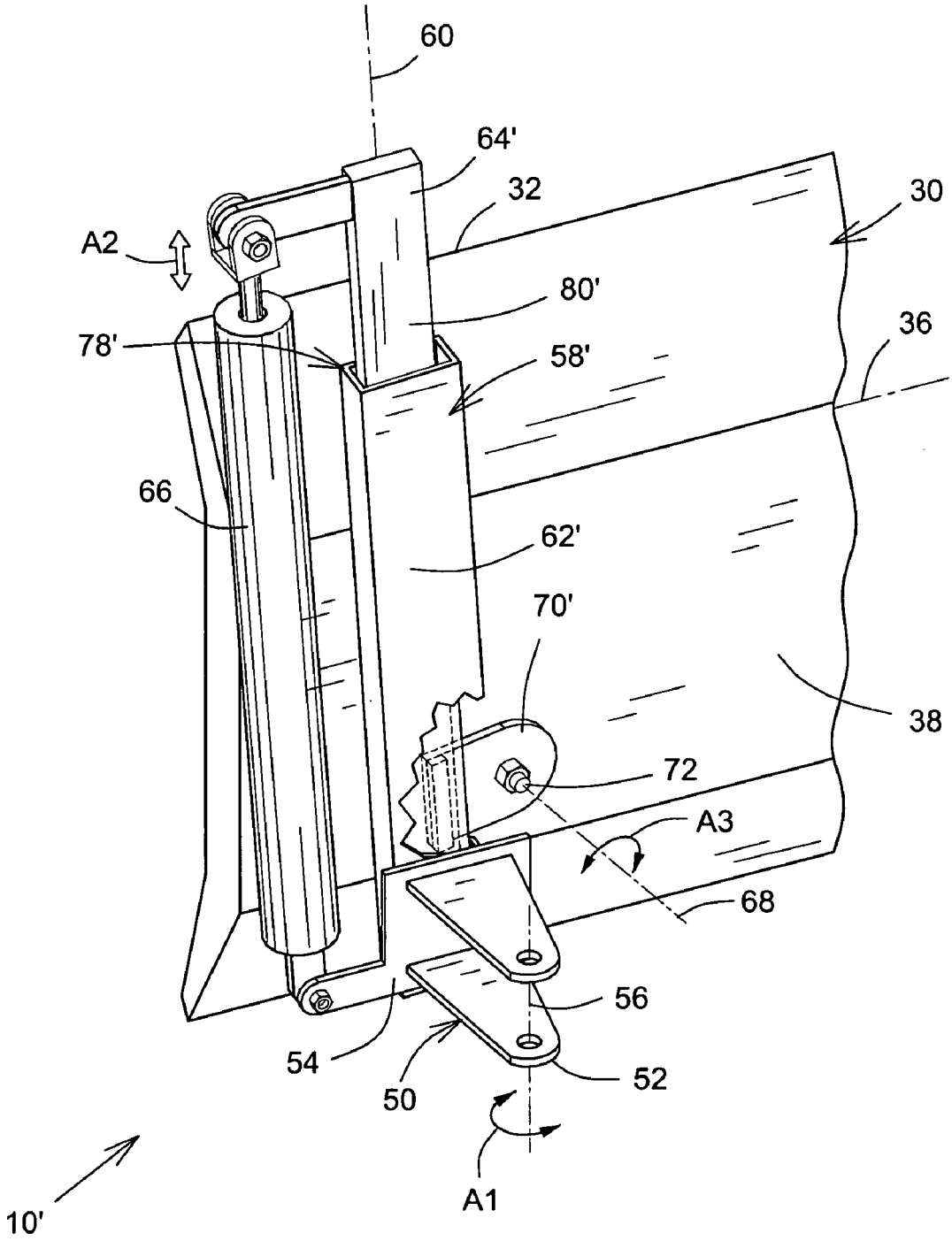
FIG. 2*a* is a view similar to FIG. 2, showing another embodiment of a mounting bracket for side blade in accordance with the present invention.

In an alternative embodiment of the bracket 10' as shown in FIG. 2*a*, the first guide part 62' of the guide member 58' includes the channel 78' longitudinally extending thereal-ong, with a typical C-shaped cross-sectional configuration, and the second guide part 64' is the elongate plate 80' that slidably engages the channel 78' for longitudinal displacement relative to the first guide part 62'. The plate 80', via the extension plate 70' partially shown in dotted lines in FIG. 2*a*, is pivotally connected to the blade pivot 72.

The actuator 66 could obviously be of any type of conventional actuator used in the art, such as a worm gear based arrangement, a cable pulley system or the like, without departing from the scope of the present invention.

Although the present brackets 10, 10' of a frontward mounting bracket for side blade have been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

I claim:

1. A bracket for connecting a side blade to a vehicle side adjacent a road surface, the side blade having opposed first and second blade longitudinal ends and defining a longitudinal blade axis therebetween, said bracket comprising:

a spacer having opposed first and second spacer ends, said first spacer end being positionable adjacent the vehicle side and pivotally connectable thereto about a substantially vertical pivot axis, said second spacer end being spaced apart from said first spacer end in a direction leading outwardly away from the vehicle side;

an elongate guide member defining a substantially vertical guide axis, said guide member having first and second guide parts longitudinally moving relative to one another, said first guide part connecting to said second spacer end, said second guide part being pivotally connectable to the first blade end about a substantially horizontal axis.

2. The bracket of claim 1, further including:

an actuator connecting to said first and second guide parts, said actuator longitudinally moving said first guide part relative to said second guide part along said guide axis.

3. The bracket of claim 1, wherein the side blade defines a blade plane, said horizontal axis being substantially transversal to said blade plane, said horizontal axis being spaced apart from the first blade end in a direction leading away from the second blade end.

4. The bracket of claim 1, wherein said second guide part includes a channel longitudinally extending therealong, said first guide part being in guiding engagement with said channel for longitudinal displacement relative to said second guide part.

5. The bracket of claim 4, wherein said first guide part is an elongate plate, said channel having a C-shaped cross-sectional configuration for being longitudinally engageable by said elongate plate.

6. The bracket of claim 1, wherein said first and second guide parts are an elongate plate and a C-shaped cross-section beam, respectively, said elongate plate slidably engaging said C-shaped cross-section beam for longitudinal displacement relative thereto.

7. The bracket of claim 1, wherein said first guide part includes a channel longitudinally extending therealong, said second guide part being in guiding engagement with said channel for longitudinal displacement relative to said first guide part.

8. The bracket of claim 7, wherein said second guide part is an elongate plate, said channel having a C-shaped cross-sectional configuration for being longitudinally engageable by said elongate plate.

9. The bracket of claim 1, wherein said first and second guide parts are a C-shaped cross-section beam and an elongate plate, respectively, said elongate plate slidably engaging said C-shaped cross-section beam for longitudinal displacement relative thereto.

10. The bracket of claim 1, wherein said guide axis is substantially perpendicular to the longitudinal blade axis.

11. The bracket of claim 1, wherein the side blade is pivotally linkable to vehicle side at a link attachment area located intermediate the first and second blade ends, said guide axis being substantially tangentially oriented relative to said link attachment area.

12. A side blade mountable on a motor vehicle for plowing material located onto an adjacent ground surface away from a vehicle side thereof, said side blade comprising:

generally opposed first and second blade longitudinal ends defining a longitudinal blade axis therebetween, said second blade end being movably connected to the vehicle side rearwardly away from a front end thereof;

a bracket for connecting the first blade end adjacent the vehicle front end, said bracket including:

a spacer having opposed first and second spacer ends, said first spacer end pivotally connecting to the vehicle side adjacent the front end about a substantially vertical pivot axis, said second spacer end being spaced apart from said first spacer end in a direction leading outwardly away from the vehicle side;

an elongate guide member defining a substantially vertical guide axis, said guide member having first and second guide parts longitudinally moving relative to one another, said first guide part connecting to said second spacer end, said second guide part connecting to the side blade adjacent the first blade end.

13. The side blade of claim 12, further including:

an actuator connecting to said first and second guide parts, said actuator longitudinally moving said first guide part relative to said second guide part along said guide axis.

14. The side blade of claim 12, wherein said second guide part includes a channel longitudinally extending therealong, said first guide part being in guiding engagement with said channel for longitudinal displacement relative to said second guide part.

15. The side blade of claim 14, wherein said first guide part is an elongate plate, said channel having a C-shaped cross-sectional configuration for being longitudinally engageable by said elongate plate.

16. The side blade of claim 12, wherein said first guide part includes a channel longitudinally extending therealong, said second guide part being in guiding engagement with said channel for longitudinal displacement relative to said first guide part.

17. The side blade of claim 16, wherein said second guide part is an elongate plate, said channel having a C-shaped cross-sectional configuration for being longitudinally engageable by said elongate plate.

18. The side blade of claim 12, wherein said guide axis is substantially perpendicular to the longitudinal blade axis.

19. The side blade of claim 12, wherein said second guide part is pivotally connected to the first blade end about a substantially horizontal axis.

20. A motor vehicle for plowing material located onto an adjacent ground surface away from a vehicle side thereof said vehicle comprising:

a side blade having generally opposed first and second blade longitudinal ends defining a longitudinal blade axis therebetween, said second blade end being movably connected to the vehicle side rearwardly away from a front end thereof;

a bracket for connecting the first blade end adjacent the vehicle front end, said bracket including:

a spacer having opposed first and second spacer ends, said first spacer end pivotally connecting to the vehicle side adjacent the front end about a substantially vertical pivot axis, said second spacer end being spaced apart from said first spacer end in a direction leading outwardly away from the vehicle side;

an elongate guide member defining a substantially vertical guide axis said guide member having first and second guide parts longitudinally moving relative to one another, said first guide part connecting to said second spacer end, said second guide part connecting to the side blade adjacent the first blade end.

* * * * *